US010486298B2

(12) United States Patent
Parker et al.

(10) Patent No.: US 10,486,298 B2
(45) Date of Patent: Nov. 26, 2019

(54) MULTI-BIT SCREWDRIVER

(71) Applicants: Chadwick Sterling Parker, Schaumburg, IL (US); Zheng Huang, Schaumburg, IL (US)

(72) Inventors: Chadwick Sterling Parker, Schaumburg, IL (US); Zheng Huang, Schaumburg, IL (US)

( * ) Notice: Subject to any disclaimer, the term of this patent is extended or adjusted under 35 U.S.C. 154(b) by 172 days.

(21) Appl. No.: 15/663,973

(22) Filed: Jul. 31, 2017

(65) Prior Publication Data

US 2018/0229357 A1 Aug. 16, 2018

Related U.S. Application Data

(60) Provisional application No. 62/459,127, filed on Feb. 15, 2017.

(51) Int. Cl.

| | |
|---|---|
| ***B25G 1/08*** | (2006.01) |
| ***B25B 15/02*** | (2006.01) |
| ***B25B 23/00*** | (2006.01) |

(52) U.S. Cl.

CPC ..... *B25G 1/085* (2013.01); *B25B 15/02* (2013.01); *B25B 23/0035* (2013.01)

(58) Field of Classification Search

CPC ..... B25G 1/085; B25B 15/02; B25B 23/0035
USPC ..... 81/52, 490; 206/377–379
See application file for complete search history.

(56) References Cited

U.S. PATENT DOCUMENTS

| | | | | | |
|---|---|---|---|---|---|
| 3,072,244 | A * | 1/1963 | Smith | B65D 83/02 | 206/379 |
| 4,278,119 | A * | 7/1981 | Elmore | B25G 1/085 | 81/490 |
| 5,279,413 | A * | 1/1994 | Nehl | A45C 1/02 | 206/0.82 |
| 5,562,212 | A * | 10/1996 | Rosler | B25H 3/003 | 206/379 |
| 5,918,513 | A * | 7/1999 | Ho | B25G 1/085 | 81/177.4 |
| 6,196,093 | B1 * | 3/2001 | Hu | B25G 1/085 | 16/111.1 |
| 6,314,600 | B1 * | 11/2001 | Cachot | B25F 1/003 | 7/128 |
| 6,629,478 | B2 * | 10/2003 | Kozak | B25G 1/085 | 81/177.4 |
| 7,107,885 | B2 * | 9/2006 | Chen | B25F 1/02 | 81/177.4 |
| 7,374,042 | B2 * | 5/2008 | Liu | B25H 3/003 | 206/372 |
| 8,978,887 | B2 * | 3/2015 | Chen | B25H 3/003 | 206/372 |
| 9,089,955 | B2 * | 7/2015 | Johnson | B25B 23/0028 | |
| 9,782,886 | B2 * | 10/2017 | Chuang | B25G 1/063 | |

* cited by examiner

*Primary Examiner* — Hadi Shakeri
(74) *Attorney, Agent, or Firm* — Dunlap Bennett & Ludwig PLLC; Brendan E. Squire

(57) ABSTRACT

An improved multi-bit screwdriver tool that retains a plurality of screwdriver bits in a screwdriver tool handle. An actuator bar is operable to conveniently extend the plurality of bits from a lateral aspect of the screwdriver body to permit convenient selection of a desired bit from the plurality of bits. Once a desired bit is selected, the actuator bar is released to retract the bits in a stowed condition.

8 Claims, 4 Drawing Sheets

MULTI-BIT SCREWDRIVER

CROSS-REFERENCE TO RELATED APPLICATION

This application claims the benefit of priority of U.S. provisional application No. 62/459,127, filed Feb. 15, 2017, the contents of which are herein incorporated by reference.

BACKGROUND OF THE INVENTION

The present invention relates to hand tools and, more particularly, multi-bit screwdrivers.

There are numerous multi-bit screwdrivers in the art. A large number of these rely on a separate bit carrier for holding the bits for the user to select from. This can be inconvenient as one of the bit carrier or the bit holding screwdriver may become lost or misplaced. This can be particularly inconvenient when the user has a need for the tool to perform a task.

Other multi-bit screwdrivers include a storage compartment within the handle of the screwdriver. This can be inconvenient when the user desires to change a bit. The user will have to attempt to shake out the desired bit from within the storage compartment or will need to empty the bits into their hand to select the desired bit. The remaining bits then need to be returned to the compartment and the compartment lid secured to the bit holding screwdriver.

As can be seen, there is a need for an improved multi-bit screwdriver that allows the bits to be retained with the tool and allows the user to conveniently select a desired bit.

SUMMARY OF THE INVENTION

In one aspect of the present invention, a screwdriver, includes an elongate body having a first end, a second end, and a lateral sidewall. A bit drive is defined in at least one of the first end or the second end and is configured to receive a replaceable bit. A bit magazine is carried within the elongate body. The bit magazine is configured to selectively extend and retract a plurality of bits through the lateral sidewall and is operable between a stowed bit position and a bit selection position. A plurality of apertures are defined in a spaced apart relation along the lateral sidewall, each of the plurality of apertures configured to receive one of the plurality of bits. An actuator bar is carried in the bit magazine and is operable to extend and retract the plurality of bits. A spring is provided to bias the actuator bar in the stowed bit position.

In some embodiments, a magnet is configured to releasably retain the plurality of bits to the actuator bar. In other embodiments, the actuator bar is magnetized.

A telescoping guide pin may extend between a first sidewall of the magazine and an opposite sidewall of the magazine, with the spring and the actuator bar carried on the telescoping guide pin.

A notch may be defined in the lateral sidewall and is configured to receive an operator's finger for operation of the actuator bar between the stowed bit position and the bit selection position. In some embodiments, the elongate body is generally rectangular, while in others the elongate body is generally cylindrical. In other embodiments, one or more bits are carried in the bit magazine.

In other aspects of the invention a screwdriver has an elongate body having a first end, a second end, and a lateral sidewall. A bit drive is defined in the first end and is configured to receive a replaceable bit. An actuator bar is operable within the elongate body to selectively extend and retract the plurality of bits through a plurality of apertures defined in a spaced apart relation in the lateral sidewall. The actuator bar is operable between a stowed bit position and a bit selection position. The actuator bar may be magnetized in some embodiments to retain the plurality of bits. A spring may be provided to bias the actuator bar in the stowed bit position. The screwdriver preferably includes a plurality of bits received in the plurality of apertures. In some embodiments, the elongate body is generally rectangular, while in others it may be generally cylindrical.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved multi-bit screwdriver tool that retains a plurality of screwdriver bits in a screwdriver tool handle and conveniently extends the plurality of bits from the screwdriver to permit convenient selection of a desired bit from the plurality of bits.

Figure 1:
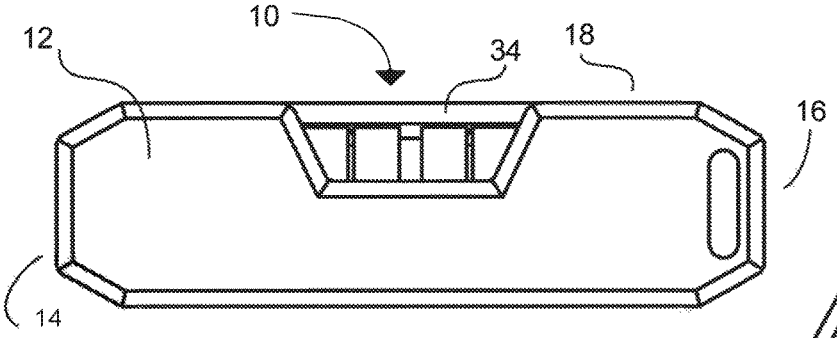
FIG. 1 is a front elevation view of a multi-bit screwdriver.
Figure 3:
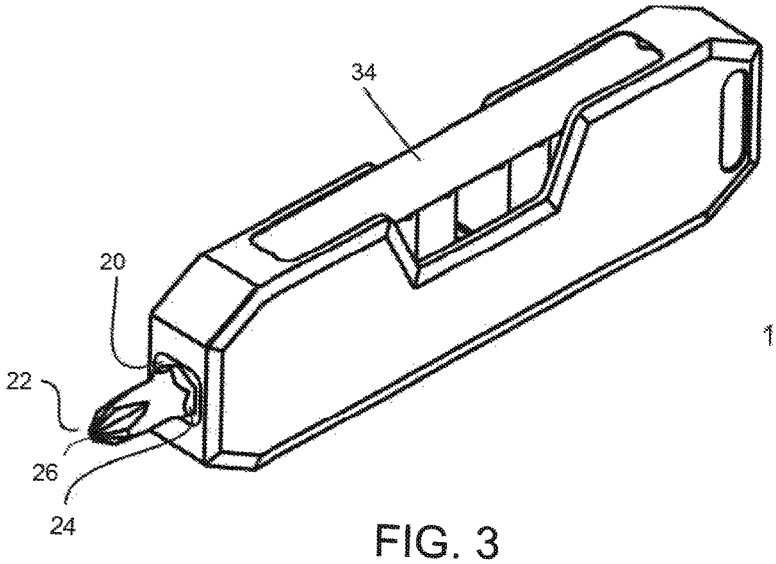
FIG. 3 is a front perspective view of a multi-bit screwdriver carrying a bit.
Figure 2:
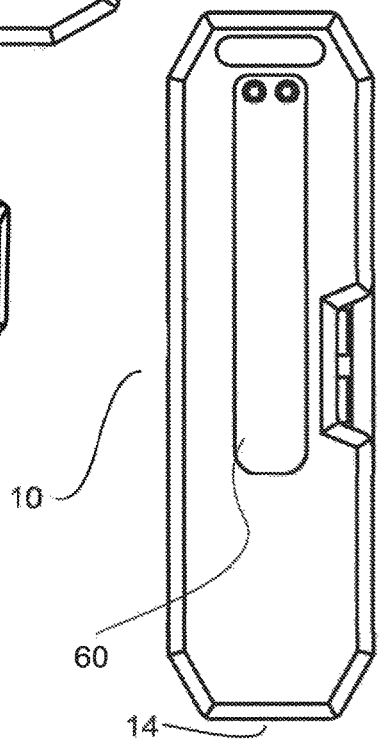
FIG. 2 is a rear elevation view of a multi-bit screwdriver.

As seen in reference to FIG. 1 an embodiment of a multi-bit screwdriver 10 is shown with an elongate body 12 having a first end 14, a second end 16, and at least one lateral sidewall 18. An interior cavity is defined within the elongate body 12 along a longitudinal length thereof. The elongate body 12 may be formed in a generally rectangular configuration or it may be cylindrical in shape. In the rectangular configuration, a belt retaining clip 60 may be included on at least one of the front surface or the back surface of the elongate body 12.

A bit drive 20 is defined in at least one of the first end 14 or the second end 16. The bit drive 20 is configured to releasably receive a screwdriver bit 22 for rotationally driving a fastener having a head corresponding to a selected type of bit 22. The type of bit 22 may be one or more of a Phillips, a standard slotted, a Torx, an Allen, a socket, or other special purpose tip. The bit 22 may also include one or more sizes for the corresponding bit type, #1, #2, etc. Typical interchangeable screwdriver bits 22 include a hexagonal shank portion 24 from which the tip 26 extends, commonly referred to as a ¼" hex bit. While, depicted as hexagonal, the shank 24 and bit drive 20 may be of any suitable shape.

Figure 5:
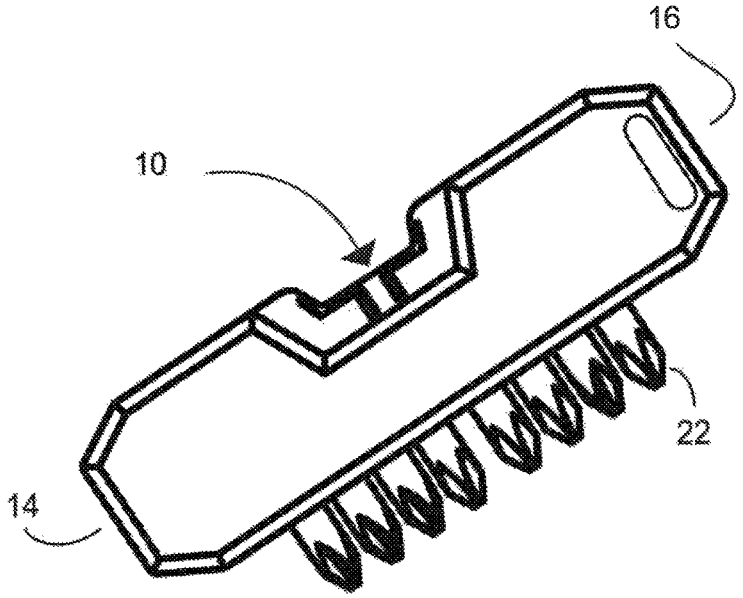
FIG. 5 is a side view of a multi-bit screwdriver in an extended bit selection mode.
Figure 4:
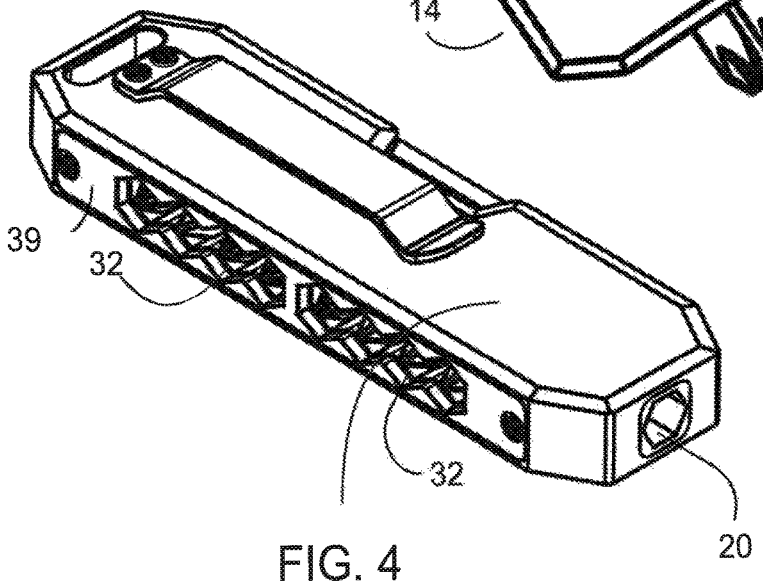
FIG. 4 is a rear perspective view of a multi-bit screwdriver.
Figure 6:
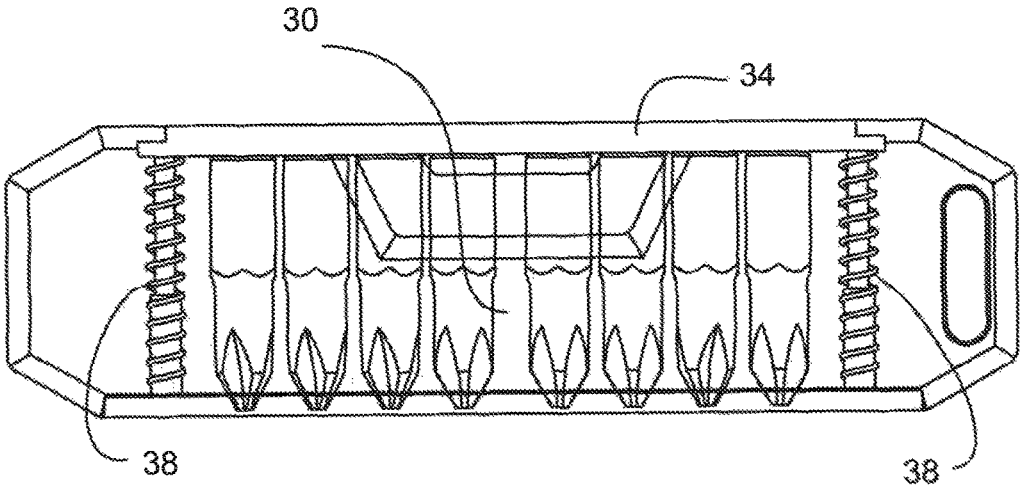
FIG. 6 is a side sectional view of a multi-bit screwdriver in a retracted bit storage mode.
Figure 7:
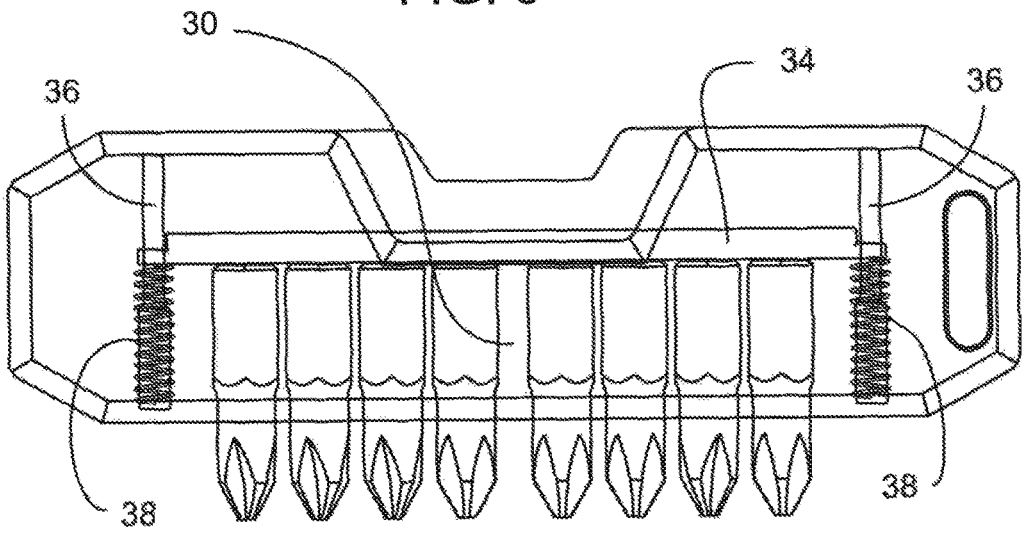
FIG. 7 is a side sectional view of a multi-bit screwdriver in an extended bit selection mode.
Figure 8:
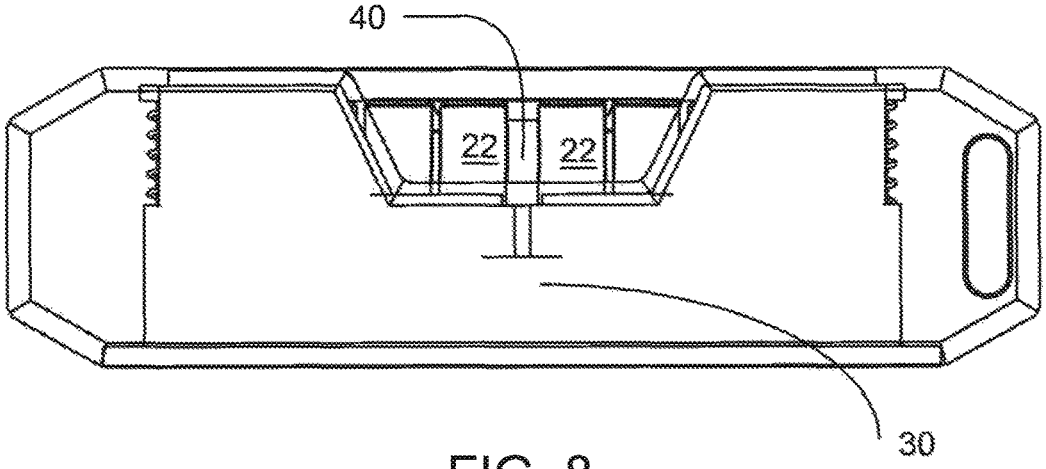
FIG. 8 is a side sectional view of a multi-bit screwdriver showing a bit carrier.
Figure 9:
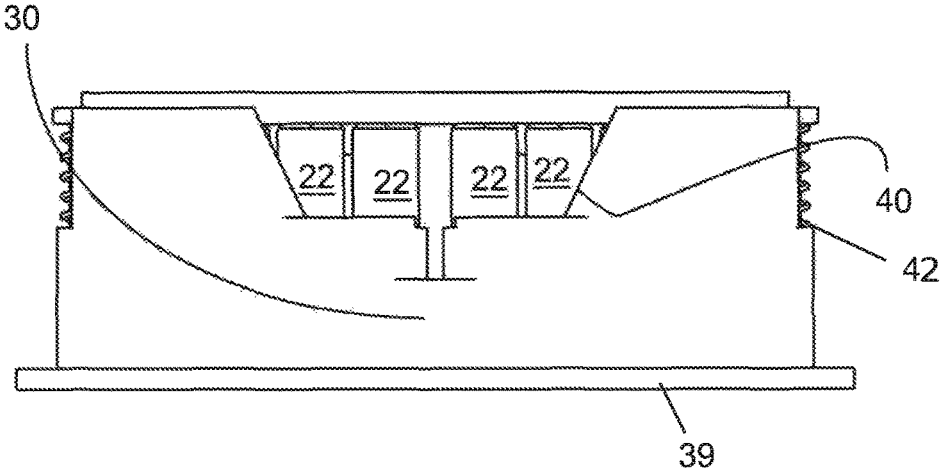
FIG. 9 is a side elevation view of the bit carrier.
Figure 10:
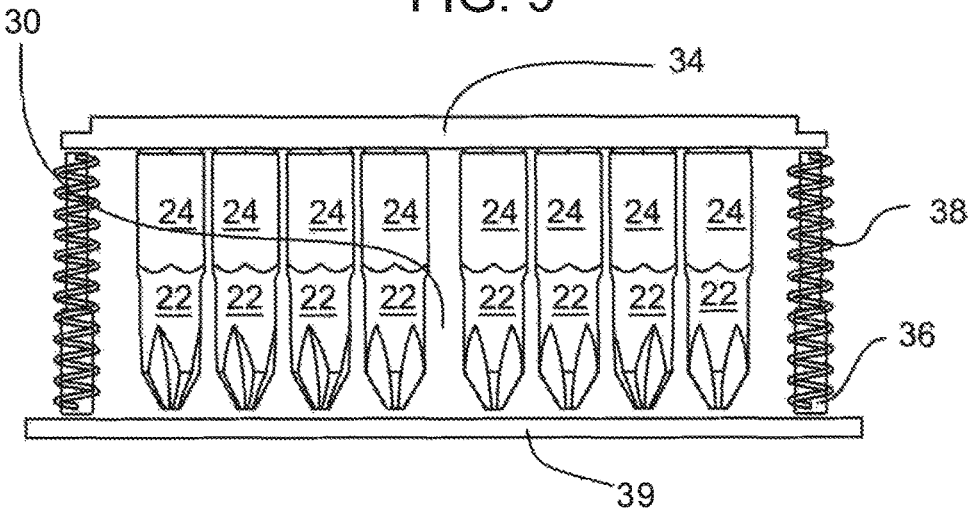
FIG. 10 is a side sectional view of the bit carrier.

The interior cavity is dimensioned to receive a bit magazine 30 within the elongate body 12. The bit magazine 30 is configured to selectively extend and retract a plurality of bits 22 through the lateral sidewall 18 and is operable between a stowed bit position, such as shown in FIGS. 1-4, 6, and 8, and a bit selection position, as shown in FIGS. 5 and 7. The bit magazine 30 may include a plurality of apertures 32 defined in a spaced apart relation along the lateral wall 18. Each of the plurality of apertures 32 is configured to receive one of the plurality of bits 22.

An actuator bar 34 may be carried by the bit magazine 30 and is operable to extend and retract the plurality of bits 22. The bit magazine 30 may be configured as a substantially rectangular body, with the actuator bar 34 defining a top of the magazine 30 and a plate 39 in which the plurality of apertures 32 are defined forms a bottom of the bit magazine 30. The actuator bar 34 may be carried on a telescoping pin 36 configuration, a slot and pin, or the like. The actuator bar 34 may be biased by a spring 38, carried on the pin 36, or otherwise operable to bias the actuator bar 34 in the stowed bit position. A shelf 42 may be formed on a left and a right side of the bit magazine 30 to serve as a stop for a limit of travel of the actuator bar 34.

One or more magnets may be carried on the actuator bar 34 to magnetically and releasably retain the bits 22 in the bit magazine 30. Alternatively, the actuator bar 34 may be magnetized to retain the plurality of bits 22. Similarly, the shank 26 may also be magnetized or include a magnet and the actuator bar 34 may then be formed of a ferrous material to attract the shank 26.

A finger notch 40 may be defined in a side of the elongate body 12 that allows the user to press the actuator bar 34 for extension of the bits 22 through the apertures 32. The bit magazine 30 may also be configured with a corresponding finger notch 40.

In use, the bit magazine 30 may be loaded with a plurality of bits 22 corresponding to one or more bit types and sizes for use on a particular task. The user may select a desired bit 22 from the plurality of bits 22 for insertion into the bit drive 20. When the user needs to change the bit 22, the one in the bit drive 20 is removed, the actuator bar 34 is pressed to extend the plurality of bits 22 through the apertures 32. The user may then choose a desired bit 22 from the plurality of bits projecting outwardly of the elongate body 12 and extract the desired bit from the aperture 32. The user may then release the actuator bar 34 and insert the unused bit 22 into a vacant aperture 32 for storage of the unused bit 22 in the bit magazine 30. The user may then insert the selected desired bit 22 into the bit drive 20 and resume their work task with the screwdriver.

It should be understood, of course, that the foregoing relates to exemplary embodiments of the invention and that modifications may be made without departing from the spirit and scope of the invention as set forth in the following claims.

What is claimed is:

1. A screwdriver, comprising:

an elongate body having a first end, a second end, and a pair of opposed lateral sidewalls defining an interior cavity within the elongated body, a notch in a top portion of the body, and an opening in a bottom portion of the body;

a bit drive defined in at least one of the first end and the second end, the bit drive configured to receive a replaceable bit;

a bit magazine received within the interior cavity of the elongate body operable between a stowed bit position and a bit selection position, the bit magazine including an actuator bar and a bottom plate, the actuator bar positioned to be received within the notch and the bottom plate extending along the opening in the bottom portion of the elongated body;

a first end and a second end of the actuator bar are carried on a plurality of guide pins extending into the interior cavity from a first end and a second end of the bottom plate, a spring carried on each of the plurality of guide pins between the actuator bar and the bottom plate biasing the actuator bar in the stowed bit position, the actuator bar configured to selectively extend and retract a tip end of a plurality of bits through the bottom plate while retaining a shank end of the plurality of bits within the interior cavity of the elongated body.

2. The screwdriver of claim 1, further comprising:

a plurality of apertures defined in a spaced apart relation along the bottom plate, each of the plurality of apertures configured to receive one of the plurality of bits.

3. The screwdriver of claim 1, wherein the actuator bar is magnetized.

4. The screwdriver of claim 1, further comprising:

a notch defined in the lateral sidewall, the notch configured to receive an operator's finger for operation of the actuator bar between the stowed bit position and the bit selection position.

5. The screwdriver of claim 1, wherein the elongate body is generally rectangular.

6. The screwdriver of claim 1, further comprising:

one or more bits carried in the bit magazine.

7. The screwdriver of claim 6, further comprising:

a magnet configured to releasably retain the one or more bits to the actuator bar.

8. The screwdriver of claim 1, further comprising:

a shelf formed on a left and a right side of the bit magazine to serve as a stop for a limit of travel of the actuator bar.

* * * * *